US005850191A

United States Patent [19]

Yagi et al.

[11] Patent Number: 5,850,191

[45] Date of Patent: Dec. 15, 1998

[54] MOVING VEHICLE SPECIFICATION SYSTEM INCLUDING AN AUXILIARY SPECIFICATION FUNCTION

[75] Inventors: Koichi Yagi, Toyota; Hajime Amano, Nishikamo-gun, both of Japan

[73] Assignee: Toyota Jidosha Kabushiki Kaisha, Toyota, Japan

[21] Appl. No.: 761,999

[22] Filed: Dec. 11, 1996

[30] Foreign Application Priority Data

Dec. 12, 1995 [JP] Japan ..... 7-323301

[51] Int. Cl.[6] ..... G08G 1/00

[52] U.S. Cl. ..... 340/928; 235/384

[58] Field of Search ..... 340/928; 235/384

[56] References Cited

U.S. PATENT DOCUMENTS 5,640,156 6/1997 Okuda et al. ..... 340/928

FOREIGN PATENT DOCUMENTS 616 302 9/1994 European Pat. Off. .
4-34684 2/1992 Japan .
8-186534 7/1996 Japan .
8-293049 11/1996 Japan .

*Primary Examiner*—Harold Pitts
*Attorney, Agent, or Firm*—Cushman Darby & Cushman IP Group of Pillsbury Madison & Sutro LLP

[57] ABSTRACT

A moving vehicle specification system having an auxiliary specification function. If a vehicle could not be specified by a local controller, the license plate number is decoded from a license plate image in a method where a number database is referenced according to grouped information and number information is retrieved. Auxiliary specification of the vehicle is performed through a comparison between the searched result and the decoded result. This prevents any impairment in the real-time performance of the processing based on local controller and permits more accurate vehicle specification.

3 Claims, 8 Drawing Sheets

VEHICLE SPECIFICATION FLOW

MOVING VEHICLE SPECIFICATION SYSTEM INCLUDING AN AUXILIARY SPECIFICATION FUNCTION

BACKGROUND OF THE INVENTION

1. Field of the Invention

This invention relates to a moving vehicle specification system for specifying in general vehicles in free lane travel on a road having multiple lanes.

2. Description of the Prior Art

Heretofore, various systems have been proposed for debiting tolls against vehicles traveling on toll roads. For example, Japanese Patent Laid-Open Publication No. Hei 4-34684 discloses a system having functions to optically detect vehicles entering a tollgate, as well as their lengths and types, and to separate and detect multiple cars entering the tollgate consecutively. According to the related system, tolls can be debited against vehicles moving, for example, on toll roads. Furthermore, according to this system, the license plate numbers or the portraits of drivers of the vehicles forcibly passing through the toll bars at the tollgate exit can be photographed. However, a major problem of this system is the requirement of a tollgate to let vehicles pass through one at a time. Since providing a tollgate generally necessitates providing an interchange or similar large facility, tollgate installation, maintenance, and management will result in considerable labor and cost. Furthermore, tollgates obstruct vehicular traffic so the possibility of causing traffic jams is high.

SUMMARY OF THE INVENTION

The idea for this invention is a partial functional improvement of an automatic debiting system (referred to as a "previously proposed system" hereinafter) as proposed in Japanese Patent Application No. Hei 7-82523.

In the previously proposed system, first and second gantries are arranged so as to span a predetermined number (generally a multiple number) of lanes along the direction of traffic, under which vehicles are permitted free lane travel. Debiting and debiting confirmation against moving vehicles are performed by radio communication between communication means arranged on these gantries and the moving vehicles. Furthermore, the passage of vehicles under these gantries, their passage points, timing, and so forth, are detected by loop coils, line scanners, optical distance sensors, and so forth. Moving vehicles are specified by a correlation process of the detection results and the results of communications relating to debiting or debiting confirmation. The results of specifying vehicles, or the results of photographing vehicles, for which confirmation that toll has been properly imposed was not obtained, and their drivers are transmitted to a host controller. According to the previously proposed system, tollgates can be obviated since debiting can be individually performed against multiple vehicles in free lane travel on multiple lanes. Therefore, the previously proposed system is able to solve all the aforementioned problems of prior art systems. Furthermore, the particular arrangement of vehicle detection means and the design of a process based on its output enable multiple vehicles traveling side by side or in tandem to be separated and detected with high accuracy, without any omissions, and at high speeds, and to be accurately determined for vehicle type.

However, the previously proposed system poses a trade off between real-time performance and accuracy of specifying moving vehicles. In other words, when specifying moving vehicles from the correlation of the communication data obtained during debiting and debiting confirmation and the detection data obtained from vehicle detection, the real-time performance suffers if accurate and exact specifying is to be executed since it is necessary to wait for a pair of data items required for the correlation process. Conversely, if the specifying results are to be output in real time, accurate and exact specifying cannot be executed, and a probability judgment yielding a certain degree of inaccuracy becomes unavoidable.

A first object of the present invention is to improve the specifying accuracy while maintaining the real-time performance and in turn prevent, for example, the occurrence of vehicles regarded as illegal even though they were properly debited, by adding an after-the-fact auxiliary specifying processing function to the previously proposed vehicle traffic control, management or debiting system or its various modifications. A second object of the present invention is to achieve a system having high confidentiality on treating or processing the information that allows vehicles to be specified, and requiring comparatively simple maintenance by the operator by centralizing the database provided to achieve the first object.

One aspect of the present invention is a moving vehicle specification system having communication means, vehicle detection means, specification means, a number database, and auxiliary specifying means. The communication means performs radio reception of identification information unique to individual vehicles moving on roads having multiple lanes. The vehicle detection means generates vehicle detection information by detecting the passage of corresponding vehicles at predetermined positions. The specifying means specifies moving vehicles by correlating the generated vehicle detection information and the received identification information.

Moving vehicles are, for the most part, already specified at the specifying means. However, because of the trade off between real-time performance and specification accuracy, a certain degree of specification failures must be expected if the demands of real-time performance are to be met. One characteristic of the present invention lies in providing auxiliary specification means for specifying moving vehicles that the primary specification means failed to specify. The auxiliary specification means specifically references the number database with the identification information, and compares the result with license number images obtained from photographs of the vehicle passage positions or their vicinity, thereby the vehicle detection information and/or identification information and the number information are correlated. The number database mentioned here stores a correlation of number information inscribed on the license plates of the vehicles with the corresponding identification information for vehicles having identification information.

According to the present invention, after most of moving vehicles are specified based on the correlation of vehicle detection information and identification information, auxiliary specification of at least those moving vehicles for which the specification was not successful is executed, by comparing the number information obtained from a search of the number database with the license number images obtained from photographs. Therefore, according to the present invention, the trade off between the real-time performance and the specifying accuracy can be resolved or improved since a design or functional assignment is possible, for example, where processing based on the specifying means is executed with priority on the real-time performance, and the auxiliary specifying means compensates for the inaccuracy of the specifying means. For example, when the present invention is applied to the previously proposed system, the occurrence of vehicles regarded as illegal even though they have been properly debited is reduced, while at the same time the real-time processing performance is maintained. Effects that are identical or similar to the related effects are also produced when this configuration is applied to other types of vehicle moving control or management systems.

The arrangement of the various functions comprising the present invention can be designed in various ways. As an example, an embodiment can be presented wherein multiple local controllers arranged along a road are each provided with a communication means, a vehicle detection means, and a specification means, while on the other hand, the host controller, which inputs the specification results, vehicle detection information and identification information for which the corresponding specification means failed at correlation, and the above-mentioned license number images, from the specification means in these local controllers is provided with the number database and the above-mentioned auxiliary specification means. Since the number database is centrally arranged in the host controller and the auxiliary specifying is executed by the host controller in the present embodiment, the operator, during license number data maintenance (for example, registering new license numbers for vehicles assigned with identification information), need only perform maintenance on the number database in the host controller, and not for the local controllers that are usually provided in multiple numbers. Thus, maintenance becomes comparatively easy. Furthermore, the information stored in the number database includes information that can specify a vehicle or individual, such as the license numbers and identification information of vehicles, and represents the type of information for which high security must be maintained. Achieving a centralized number database in this configuration, namely, avoiding a distributed database, can improve the protection of confidentiality of these types of information.

DETAILED DESCRIPTION OF THE PREFERRED EMBODIMENTS

Preferred embodiments of the present invention will be described with reference to the accompanying drawings in which the configuration and functions of the local controller, and the means for debiting, debiting confirmation, vehicle detection, vehicle photography, and so forth, will for simplicity be partially omitted from the description that follows. For their details and modifications, the reader should refer to the series of systems previously proposed by the applicant such as Japanese Patent Application No. Hei 7-82523 and the corresponding US Patent Application.

Figure 1:
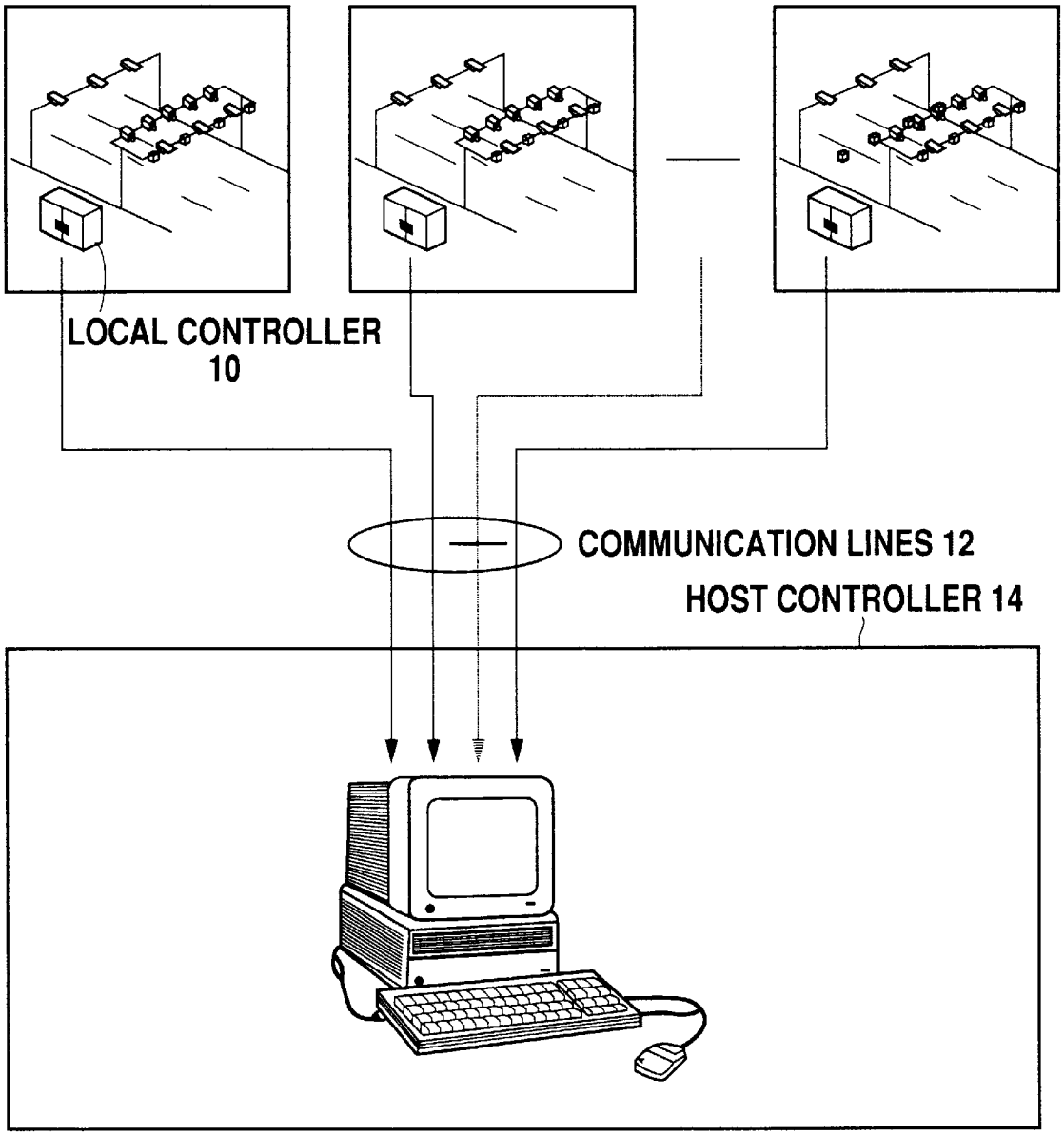
FIG. 1 is a block diagram representing a configuration of a system related to the first embodiment of this invention.

FIG. 1 shows a general configuration of an automatic debiting system related to the embodiment of the present invention. In the system shown in this figure, a local controller (LC) 10 is arranged at each required (generally multiple) position along an expressway, for example. LC 10 executes the procedure disclosed in Japanese Patent Application No. Hei 7-82523, yielding results such as the specifying of moving vehicles which are gathered at a host controller (HC) 14 via communication lines 12. HC 14 is arranged at a Land Transport Office, which is a section of the Ministry of Transportation of Japan or a similar administrative facility.

Figure 2:
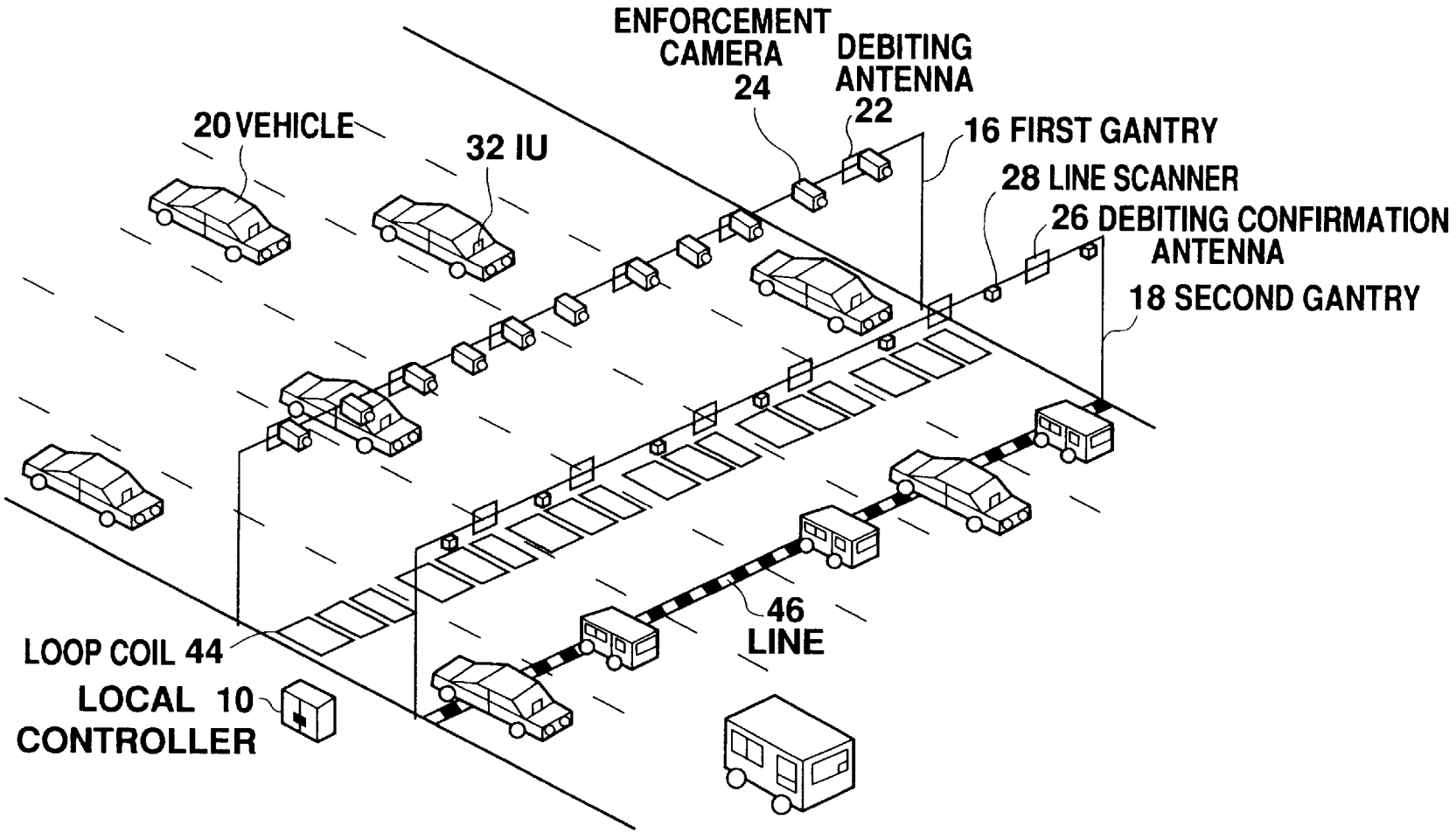
FIG. 2 is a perspective view showing an external appearance of the vicinity of first and second gantries in this embodiment.
Figure 3:
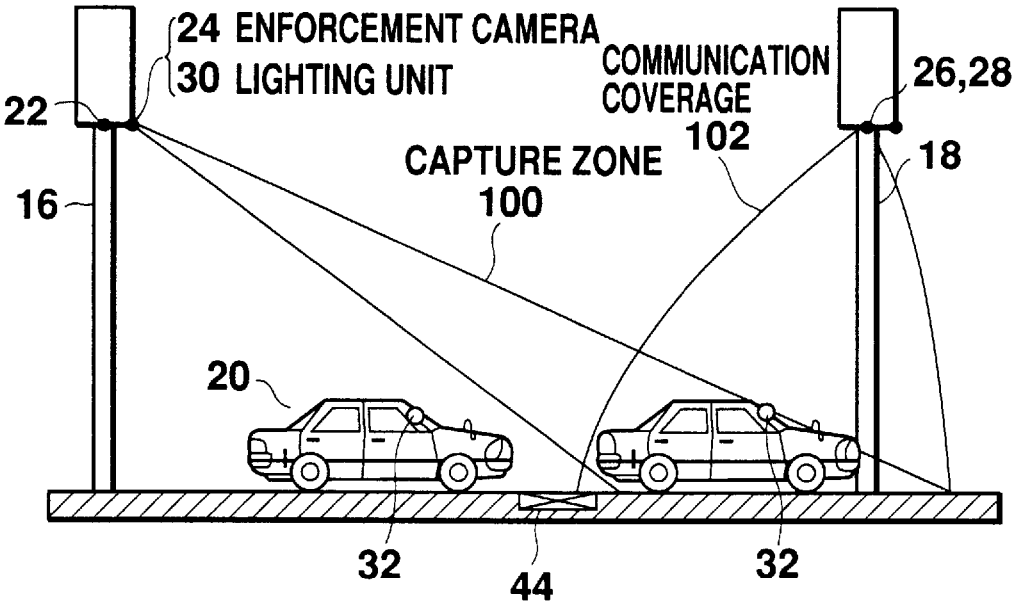
FIG. 3 is a side view showing equipment arranged on the first and second gantry.

FIG. 2 and FIG. 3 show a general arrangement of LC 10 and various types of associated equipment. The arrangement shown in these drawings represent only one example and various modifications as shown in Japanese Patent Application No. Hei 7-82523, for example, are possible. In FIG. 2, a first gantry 16 and a second gantry 18, each spanning multiple lanes (6 lanes are shown in the figure), are provided in sequence from the upstream side in the direction of traffic, and vehicles 20 are in free lane travel from the upper left of the drawing to the lower right. This system is designed so that, while vehicles 20 traveling within the maximum legal speed limit pass between first 16 and second 18 gantries, LC 10 can execute processes for debiting, debiting confirmation, illegal vehicle identification, and so forth.

Figure 4:
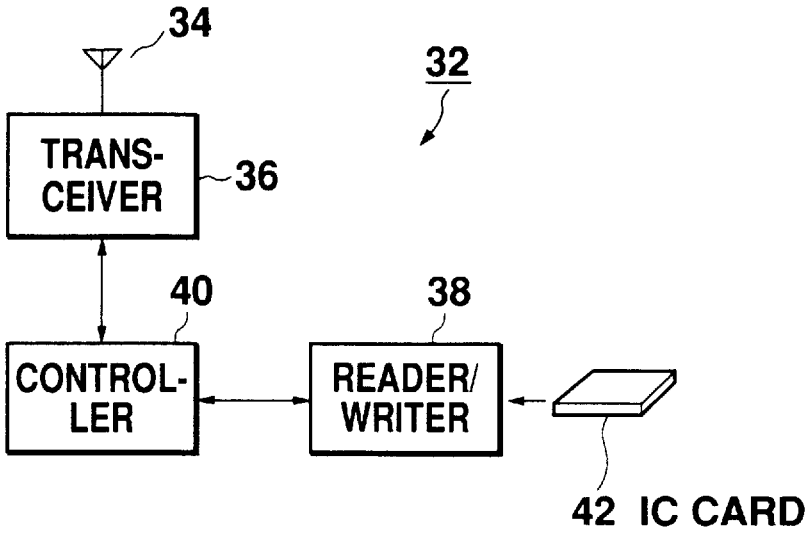
FIG. 4 is a block diagram representing a functional configuration of an in-vehicle unit (IU).

On the spanning portions of the first 16 and second 18 gantries are arranged debiting antennas 22, enforcement cameras 24, debiting confirmation antennas 26, line scanners 28, lighting units 30, and so forth. Debiting antennas 22 and debiting confirmation antennas 26 perform debiting communications and debiting confirmation communications, respectively, with vehicles 20 traveling on the road, or more specifically with their in-vehicle units (IU) 32. IU's 32 are affixed to vehicles 20, such as to their windshields (below the rearview mirror, for example), where each comprises, as shown in FIG. 4, an antenna 34 for radio communications with debiting antennas 22 and debiting confirmation antennas 26, a transceiver 36 for performing radio communications with LC 10 using antenna 34, a reader/writer 38 for writing information (such as debiting information) onto an IC card 42 or reading information (such as identification information) from IC card 42, and a controller 40 for controlling the operation of IU 32. Enforcement cameras 24 photograph the license plates of moving vehicles 20 in capture zones 100 (FIG. 3). Lighting units 30 illuminate at least their respective camera capture zones 100. A zone 102 in FIG. 3 represents the communication coverage of debiting confirmation antenna 26.

Figure 5:
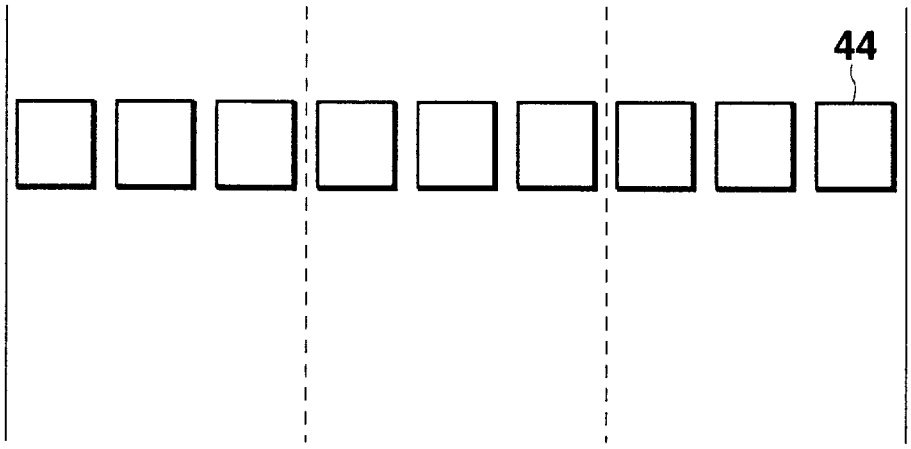
FIG. 5 is a diagram depicting an example arrangement of loop coils.

On the other hand, loop coils 44 are embedded in the road and arranged transversely across the lanes, namely, at the positions indicated by the rectangular frames in FIG. 2 and FIG. 5. Since the inductances of loop coils 44 vary with the passage of vehicles 20, the passage of vehicles 20 and their positions and timing can be known by monitoring the amplitude, phase, and so forth of the output signals from loop coils 44. The road surface is further provided with a line 46 having a black-and-white pattern. While using the black-and-white pattern to perform calibrations, line scanners 28 photograph line 46 to detect the passage of vehicles 20 and their positions and timing. Instead of these means, optical detectors based on triangulation principles, for example, may be used.

Figure 6:
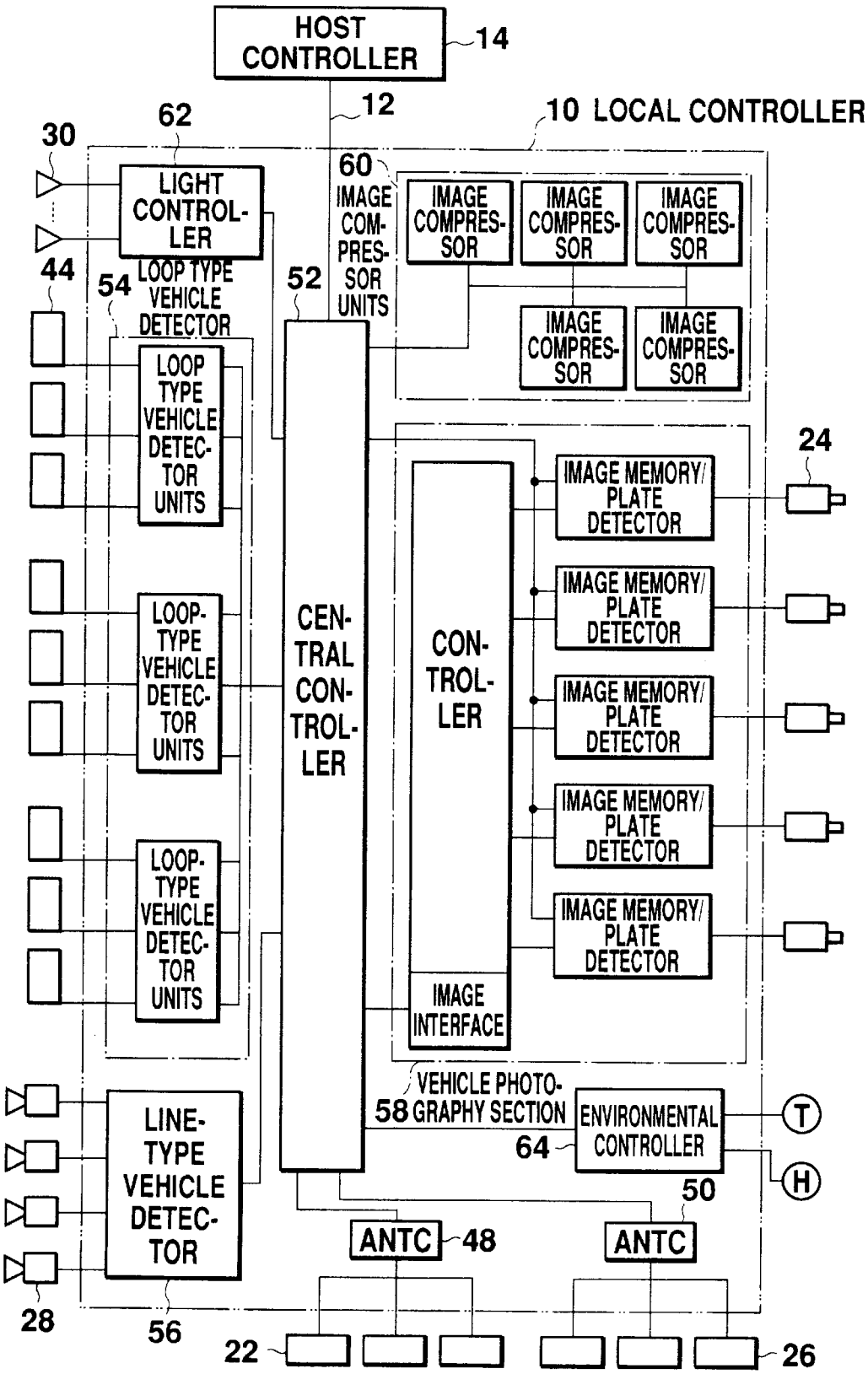
FIG. 6 is a block diagram representing a functional configuration of a local controller.

LC 10 has a configuration shown in FIG. 6, for example, in the case of a 3-lane road. In the figure, an antenna controller (ANTC) 48 and an ANTC 50 execute transmit and receive control and other control operations, under the control of a central controller 52, for respective debiting antennas 22 and debiting confirmation antennas 26. As a result, central controller 52 gathers identification information of vehicles 20 for which debiting and debiting confirmation have been completed, namely, unique codes stored in IC cards 42 or assigned to IUs 32. A loop type vehicle detector 54 performs processes relating to vehicle detection using loop coils 44, and supplies a vehicle detection signal indicating, for example, the passage of vehicles 20, to central controller 52. Central controller 52 performs, for example, vehicle type identification based on a combination of high sensitivity outputs and low sensitivity outputs of loop coils 44. A line type vehicle detector 56 performs processes relating to vehicle detection using line 46 and line scanners 28, and supplies a vehicle detection signal indicating, for example, the passage of vehicles 20, to the central controller 52. As the passage of vehicles 20 is detected by loop type vehicle detector 54 and/or line type vehicle detector 56, a capture controller 58 photographs license plates using any of the enforcement cameras 24 according to command from the central controller 52. Capture controller 58 extracts license plate images from among the images obtained from the photography and an image compressor 60 performs data compression on the images. The central controller 52 transmits the compressed images, together with specifying results, and so forth, described later, to HC 14. A light controller 62 activates lighting units 30 when the road is dark, and an environmental controller 64 supplies detected values for ambient temperature and humidity to central controller 52 to normalize the various operations of LC 10.

Figure 7:
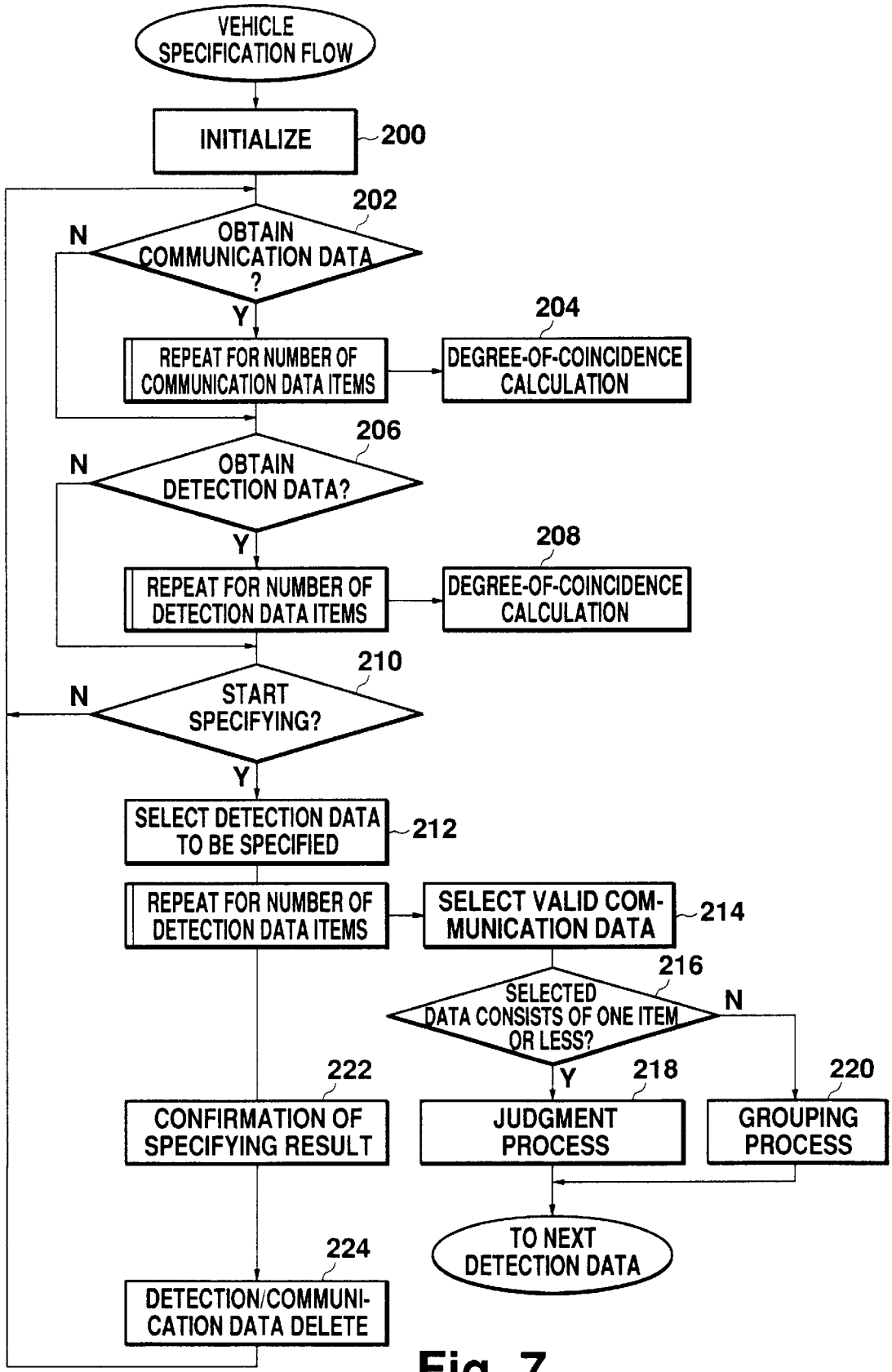
FIG. 7 is a flowchart showing a flow for a vehicle specifying process in the local controller.

Based on the communication results (communication data) by debiting antennas 22 and/or debiting confirmation antennas 26 and the results of the passage detection of vehicles 20 (detection data) by loop coils 44 and/or line scanners 28, LC 10 executes processes which should reliably verify the specification of illegal vehicles to correlate the passage of vehicles with the communication results, namely, to execute the vehicle specifying process according to the procedure shown in FIG. 7.

As shown in the figure, LC 10 first executes a predetermined initialization process (200). When, after the initialization process is executed, signals (communication data) are received (202) by debiting antennas 22 or debiting confirmation antennas 26 from IUs 32, LC 10 stores the received communication data to the database within central controller 52. LC 10 repeatedly calculates the degree-of-coincidence between the newly obtained and the previously obtained communication data (204) in proportion to the number of received communication data items. LC 10 further stores the detection data when it is obtained (206) from loop coils 44 and line scanners 28 to the database within central controller 52, and repeatedly executes degree-of-coincidence calculations regarding the detection data (208) in proportion to the quantity of the obtained detection data.

LC 10 initiates, when the conditions for initiating the vehicle specifying process have been satisfied, for example, after the elapse of a predetermined time (210), the vehicle specifying process (correlation mapping) while using the degree-of-coincidences calculated according to a predetermined algorithm in step 204 or 208 as indexes. At this time, LC 10 selects (212) the detection data to be supplied to the vehicle specifying process from among the detection data stored in the database acquired so far, and supplies the selected detection data one item at a time to the processes relating to steps 214 through 220. In other words, the processes relating to steps 214 through 220 are repeatedly executed for a number of times equal to the number of selected detection data items.

Based on the degree-of-coincidences calculated in steps 204 and 208, the communication data is selected in step 214 for which the correlation to the detection data supplied to the current vehicle specifying process is seen as valid. If the number of communication data items selected in this manner is one or less (216), LC 10 judges (218) that the vehicle 20 relating to the selected one or no communication data is the same as the vehicle 20 relating to the detection data supplied to the current vehicle specifying process. On the other hand, if a multiple number of communication data items is selected (216), LC 10 groups these communication data items and correlates them with the detection data supplied to the current vehicle specifying process (grouping process 220).

After the processes in steps 214 through 220 are executed for all detection data items selected in step 212, LC 10 generalizes the results of the processes based on steps 218 and 220 so that the detection data supplied to the vehicle specifying process is correlated as much as possible to the communication data relating to a single vehicle (confirmation of specifying result 222). LC 10 operates so that a pair of communication data and detection data items (called a "specifying result (normal)" hereinafter) specified as data relating to a single vehicle is transmitted to HC 14 when the correlation is successful, and deleted (224) from the database within central controller 52. For illegal vehicles (for example, vehicles 20 for which debiting was not properly performed due to the shortage of remainder in IC card 42) compressed images of the license plates are also transmitted with the specifying result (normal). The detection data (called a "specifying result (without IU)" hereinafter), which clearly does not have the corresponding communication data, is transmitted together with the license plate images and so forth. Furthermore, the group of communication data and detection data (called "specifying information (unable to specify)" hereinafter), which has been subjected to the grouping in step 220 and for which the specifying of a single vehicle was unsuccessful, is also transmitted together with the license plate images and so forth. After this, the flow of the vehicle specifying process by LC 10 returns to step 202 to enter a standby state for the acquisition of communication data and detection data.

Figure 8:
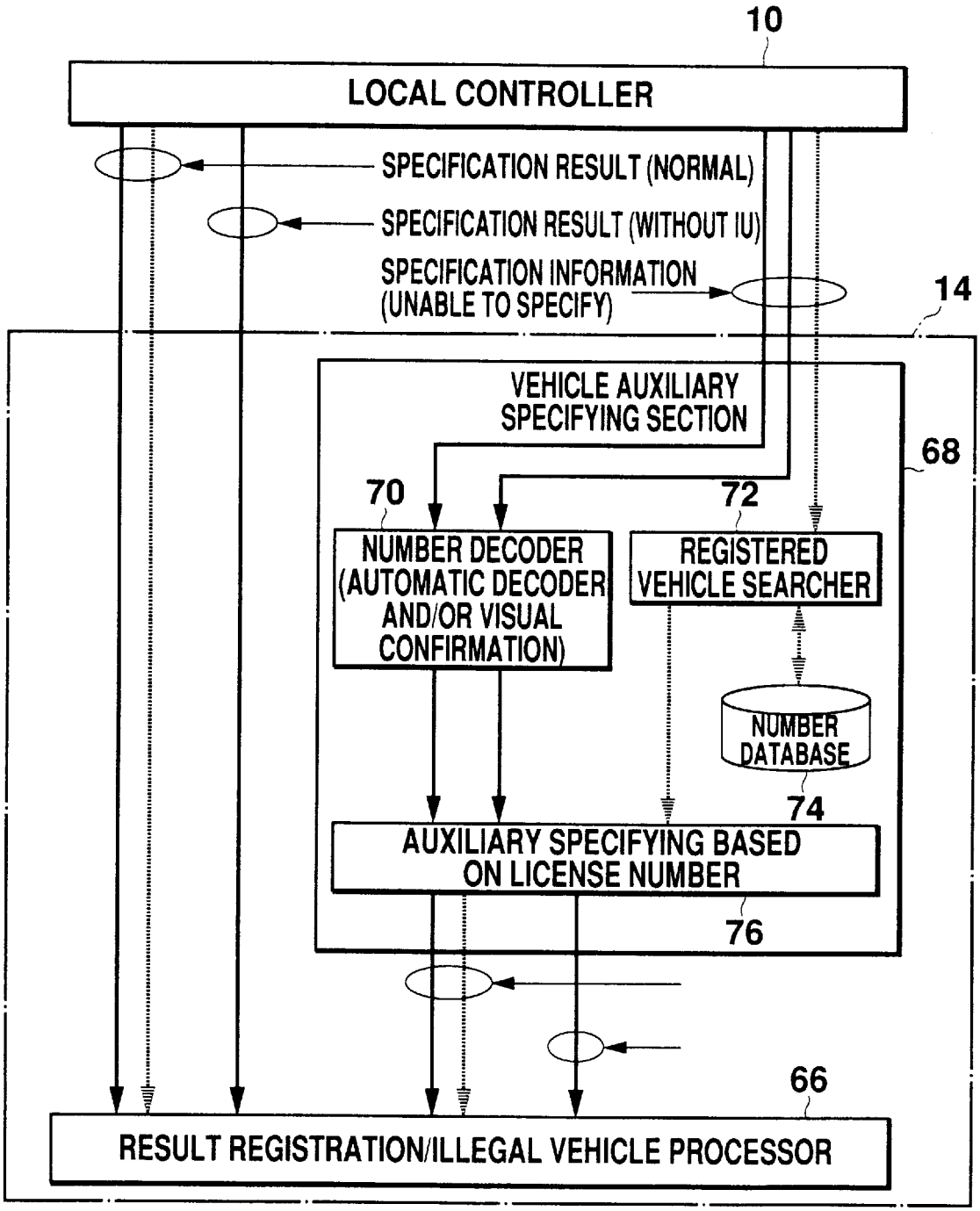
FIG. 8 is a block diagram representing a functional configuration of a host controller.

By executing this sort of process, multiple vehicles 20 traveling side by side or multiple vehicles 20 traveling in tandem can be distinguished and accurately correlated with the communication results and/or the license plate images even if the communication coverage for debiting antennas 22 and debiting confirmation antennas 26 is set to a wide area. Furthermore, by executing the processes shown in FIG. 8 and FIG. 9 at HC 14, vehicle specification (auxiliary specification) is possible in this embodiment, even with regard to specifying information (unable to specify) that is transmitted from LC 10.

Viewed functionally, HC 14 includes a result registration/illegal vehicle processor 66 and a vehicle auxiliary specifying section 68. The result registration/illegal vehicle processor 66 generally gathers specifying results (normal) and specifying results (without IU) from multiple LCs 10, registers the results to the internal database, and executes a predetermined process such as formal notice or black list registration regarding illegal vehicles based on the specifying results (without IU) and so forth. Result registration/illegal processor 66 also executes the same processes regarding the auxiliary specifying results (normal) and the auxiliary specifying results (without IU), which are supplied from vehicle auxiliary specifying section 68 and described later, as those regarding the specifying results (normal) and the specifying results (without IU) from LC 10, respectively.

Figure 9:
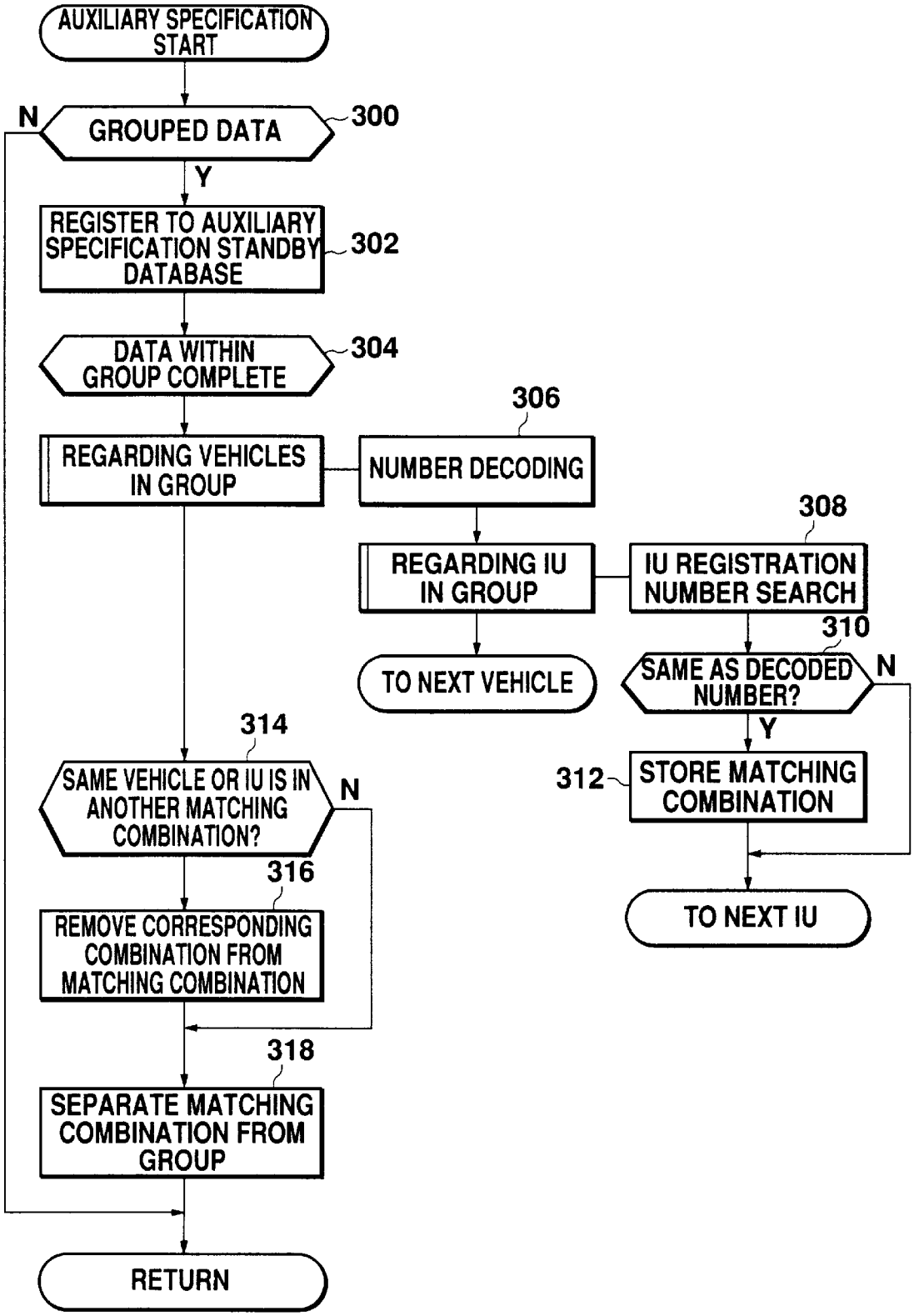
FIG. 9 is a flowchart showing a flow for a vehicle auxiliary specifying process in the host controller.

Vehicle auxiliary specifying section 68 comprises a number decoder 70, a registered vehicle searcher 72, a number database (NDB) 74, and an auxiliary specifying section 76. As shown in FIG. 9, when vehicle auxiliary specifying section 68 inputs (300) information that LC 10 has grouped in step 220, namely, specifying information (unable to specify), the license number images that are the results of photography by enforcement cameras 24 and the detection data representing information obtained by processing the outputs of loop coils 44 and/or line scanners 28 is supplied to number decoder 70, and the communication data obtained by processing the results of communications with debiting antennas 22 and debiting confirmation antennas 26 is supplied to registered vehicle searcher 72. These are registered (302) in an internal auxiliary specifying standby database by number decoder 70 and registered vehicle searcher 72.

After all the specifying information (unable to specify) belonging to a single group is received (304), vehicle auxiliary specification section 68 automatically decodes (306) license numbers from the license number images by number decoder 70. This decoding process is executed for all vehicles belonging to that group. The automatic decoding may be replaced with human-based visual confirmation, with results supplied to auxiliary specifying section 76 to be described later. On the other hand, registered vehicle searcher 72 searches (308) NDB 74 with the identification information included in the communication data, namely, the unique identification code in IU 32. NDB 74 is a database storing the correlation of the identification codes of IU's 32 with the license numbers of vehicles 20 carrying IU's 32. Therefore, as a result of this search, the license number of the vehicle 20 carrying the IU 32 relating to the corresponding communication data is identified. Repeating this sort of search will, in general, yield a license number (310) identical to the license number decoded by number decoder 70. When a license number obtained from the search is the same as the decoded license number, registered vehicle searcher 72 informs auxiliary specifying section 76 of the result so that auxiliary specifying section 76 combines and stores (312) the corresponding license number with the corresponding detection and communication data.

After number decoding and searching are collectively executed by number decoder 70 and registered vehicle searcher 72, auxiliary specifying section 76 checks that there are no discrepancies in the stored combinations (314). In other words, although the combination of communication data, detection data, and license number must show a 1:1:1 relationship, there are instances, such as due to number decoding errors, where this relationship does not hold. Accordingly, when auxiliary specifying section 76 discovers such a combination (314), this combination is deleted (316) from storage. Regarding vehicles 20 for which the auxiliary specifying was successful, auxiliary specifying section 76 separates (318) corresponding vehicles 20 from specifying information (unable to specify) and informs result registration/illegal vehicle processor 66.

Since the auxiliary specifying of vehicles 20 is executed in this manner in this embodiment at HC 14 based on specifying information (unable to specify), vehicles 20 can be accurately and precisely specified compared to the system proposed previously by the applicant when the specifying results and auxiliary specifying results that are obtained in the end are generalized. Furthermore, since vehicle auxiliary specification is performed at HC 14, it is not necessary for each LC 10 to possess its own NDB 74. Therefore, the protection of confidentiality of the data in NDB 74 can be improved and the maintenance of NDB 74 becomes easy in this embodiment. Furthermore, all the vehicle specifying processes executed in LC 10 (refer to FIG. 7) may be performed at HC 14. In this case, however, it becomes necessary to transmit all license number images regarding vehicles, against which proper debiting and debiting confirmation are being performed, to HC 14, thus causing communication lines 12 to be congested. According to the present embodiment, the specifying of vehicles 20 is performed in LC 10, and as a result, only the information for which specifying was not successful, namely, only specifying information (unable to specify), or only the license number images of vehicles 20 for which specification was successful and were thereby recognized as illegal vehicles need be transmitted from LC 10 to HC 14 so as to alleviate the congestion of communication lines 12.

This invention is not limited to the above-mentioned type of processes. For example, if specifying is performed by vehicle auxiliary specifying section 68 for the data regarding illegal vehicles in the specifying results (normal) that are transmitted from LC 10, the probability of treating vehicles 20, which should be treated as having been properly debited and confirmed, as illegal vehicles becomes small.

While there have been described what are at present considered to be preferred embodiments of the invention, it will be understood that various modifications may be made thereto, and it is intended that the appended claims cover all such modifications as fall within the true spirit and scope of the invention.

What is claimed is:

1. A moving vehicle specification system comprising:

communication means for performing radio reception, from vehicles moving on a road having a plurality of lanes, of identification information unique to each of the vehicles;

vehicle detection means for generating vehicle detection information by separately detecting vehicles that have passed predetermined positions on the road;

specification means for specifying said vehicles by correlating the vehicle detection information with the identification information;

a number database for storing a correlation of number information inscribed on the license plates of the vehicles with the identification information of corresponding vehicles; and auxiliary specifying means for, by referencing said number database with the identification information and by comparing the results thereof with license number images obtained from photographs of said predetermined positions or their vicinity, correlating the vehicle detection information and/or the identification information with the number information, and furthermore specifying vehicles that at least the specification means failed to specify.

2. A vehicle specification system according to claim 1, further comprising:

local controllers, arranged at a plurality of locations along said road, each including said communication means, vehicle detection means and specifying means; and a host controller, having said number database and said auxiliary specifying means, for inputting specifying results by specifying means, vehicle detection information and identification information for which the corresponding specifying means failed at correlation, and said license number images from a plurality of local controllers.

3. A vehicle specification system according to claim 1, wherein said communication means, by performing radio communications regarding at least debiting with said moving vehicles, performs radio reception from vehicles of identification information unique to the vehicles; and said vehicle specifying system is an automatic debiting system for automatic debiting against said vehicles and detecting illegal vehicles.

* * * * *